US007891415B2

(12) United States Patent
Ushio et al.

(10) Patent No.: US 7,891,415 B2
(45) Date of Patent: Feb. 22, 2011

(54) HEAT EXCHANGER

(75) Inventors: Takeshi Ushio, Saitama (JP); Rieko Okada, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 752 days.

(21) Appl. No.: 11/297,970

(22) Filed: Dec. 8, 2005

(65) Prior Publication Data

US 2006/0124284 A1 Jun. 15, 2006

(30) Foreign Application Priority Data

Dec. 14, 2004 (JP) ..... 2004-360726

(51) Int. Cl.
*F28F 13/00* (2006.01)
*F28D 7/02* (2006.01)
*H01M 10/50* (2006.01)

(52) U.S. Cl. ..... 165/146; 165/164; 165/901; 429/120

(58) Field of Classification Search ..... 165/162, 165/163, 164, 901, 146; 122/4 D; 429/26, 429/34, 120
See application file for complete search history.

(56) References Cited

U.S. PATENT DOCUMENTS 2,401,797 A * 6/1946 Rasmussen ..... 165/164
3,306,353 A * 2/1967 Burne ..... 165/164
3,439,739 A * 4/1969 Jaeger ..... 165/164
3,595,310 A * 7/1971 Burne et al. ..... 165/162
3,983,933 A * 10/1976 Fletcher et al. ..... 165/164
4,050,628 A * 9/1977 Konnerth, III ..... 165/901
4,396,480 A * 8/1983 Hegedus et al. ..... 429/33
4,413,041 A * 11/1983 Hegedus ..... 429/33
4,463,065 A * 7/1984 Hegedus et al. ..... 429/33
4,508,793 A * 4/1985 Kumata et al. ..... 429/26
4,578,324 A * 3/1986 Koehler et al. ..... 429/26
5,409,057 A * 4/1995 Zifferer ..... 165/164
5,472,047 A * 12/1995 Welkey ..... 165/162
6,397,787 B1 * 6/2002 Yamada et al. ..... 122/4 D
7,073,573 B2 * 7/2006 Agee ..... 165/146

FOREIGN PATENT DOCUMENTS

JP 2000-193323 7/2000
JP 2001-241872 9/2001
JP 2003-021432 1/2003
JP 2003-211945 7/2003
JP 2004-124808 4/2004

* cited by examiner

*Primary Examiner*—Ljiljana (Lil) V Ciric
(74) *Attorney, Agent, or Firm*—Fish & Richardson P.C.

(57) ABSTRACT

A heat exchanger has a heat exchange part that includes a heat supply medium channel with at least one heat supply passage and a heat recovery medium channel surrounding the heat supply medium channel. The heat exchange part is arranged such that, during operation, a heat supply medium passing through the heat supply medium channel exchanges heat with a heat recovery medium passing through the heat recovery medium channel. Cross-sectional space available to accommodate heat recovery medium flow in different sections of the heat recovery medium channel varies according to an amount of heat to be transferred from the heat supply medium to the heat recovery medium in each of the different sections.

5 Claims, 7 Drawing Sheets

HEAT EXCHANGER

CROSS-REFERENCE TO RELATED APPLICATIONS

This application claims the foreign priority benefit under Title 35, United States Code, §119 (a)-(d), of Japanese Patent Application No. 2004-360726, filed on Dec. 14, 2004 in the Japan Patent Office, the disclosure of which is herein incorporated by reference in its entirety.

BACKGROUND OF THE INVENTION

1. Field of the Invention

The present invention relates to a heat exchanger in which a heat supply medium exchanges heat with a heat recovery medium, and particularly to a heat exchanger with improved heat exchange efficiency.

2. Description of the Related Art

As a heat exchanging means, various types of heat exchangers in which heat of a heat supply medium is transferred to a heat recovery medium have been proposed. For example, Japanese Patent Application JP2003-211945A (particularly paragraphs 0032-0035, FIGS. 1 and 2) discloses a heat exchanger in which a heat exchange part has a heat recovery medium pipe with folded fins carrying oxidation catalyst thereon. In this heat exchanger, a mixed gas of hydrogen and oxygen is supplied to the heat exchange part, where the mixed gas is reacted in the presence of the oxidation catalyst. As a result, heat is generated (a heat supply medium is produced) and the generated heat is transferred through the fins to the heat recovery medium passing through the pipe. Japanese Patent Application JP2000-193323A (particularly paragraphs 0017-0018 and FIG. 1) discloses a heat exchanger in which a heat exchange part has pipes surrounded by a plurality of plate fins with the adjacent fins being disposed with a predetermined space therebetween. In this heat exchanger, gas is burnt in a combustion part and then allowed to flow between the fins, so that the heat of the combustion gas is transferred to a heat recovery medium passing through the pipe.

However in the conventional heat exchangers disclosed in the above documents, the heat supply medium channel is located outside the heat recovery medium channel, and therefore the generated heat in the heat supply medium is undesirably excessively released from the heat supply medium channel to the external system. Consequently, a large amount of thermal energy is lost and thus heat exchange efficiency becomes low.

Also in the conventional heat exchangers, heat transfer conditions between the heat supply medium and the heat recovery medium vary depending on the part in the exchanger, resulting in unevenness in temperature of the heat recovery medium. This also contributes to lowering of thermal exchange efficiency.

Therefore, it would be desirable to provide a heat exchanger which can solve the above-mentioned problems by attaining excellent heat exchange efficiency.

Illustrative, non-limiting embodiments of the present invention overcome the above disadvantages and other disadvantages not described above.

SUMMARY OF THE INVENTION

In one aspect of the present invention, a heat exchanger is provided which has a heat exchange part including heat supply medium channel formed of at least one heat supply passage and heat recovery medium channel surrounding the heat supply medium channel, in which heat exchange part a heat supply medium passing through the heat supply medium channel exchanges heat with a heat recovery medium passing through the heat recovery medium channel, wherein pressure loss in the heat recovery medium channel is adjusted corresponding to an amount of heat transferred from the heat supply medium to the heat recovery medium, by configuration of a cross-sectional area of the heat recovery medium channel.

BRIEF DESCRIPTION OF THE DRAWINGS

The various aspects, other advantages and further features of the present invention will become more apparent by describing in detail illustrative, non-limiting embodiments thereof with reference to the accompanying drawings.

DETAILED DESCRIPTION OF THE EXEMPLARY EMBODIMENTS

Figure 1:
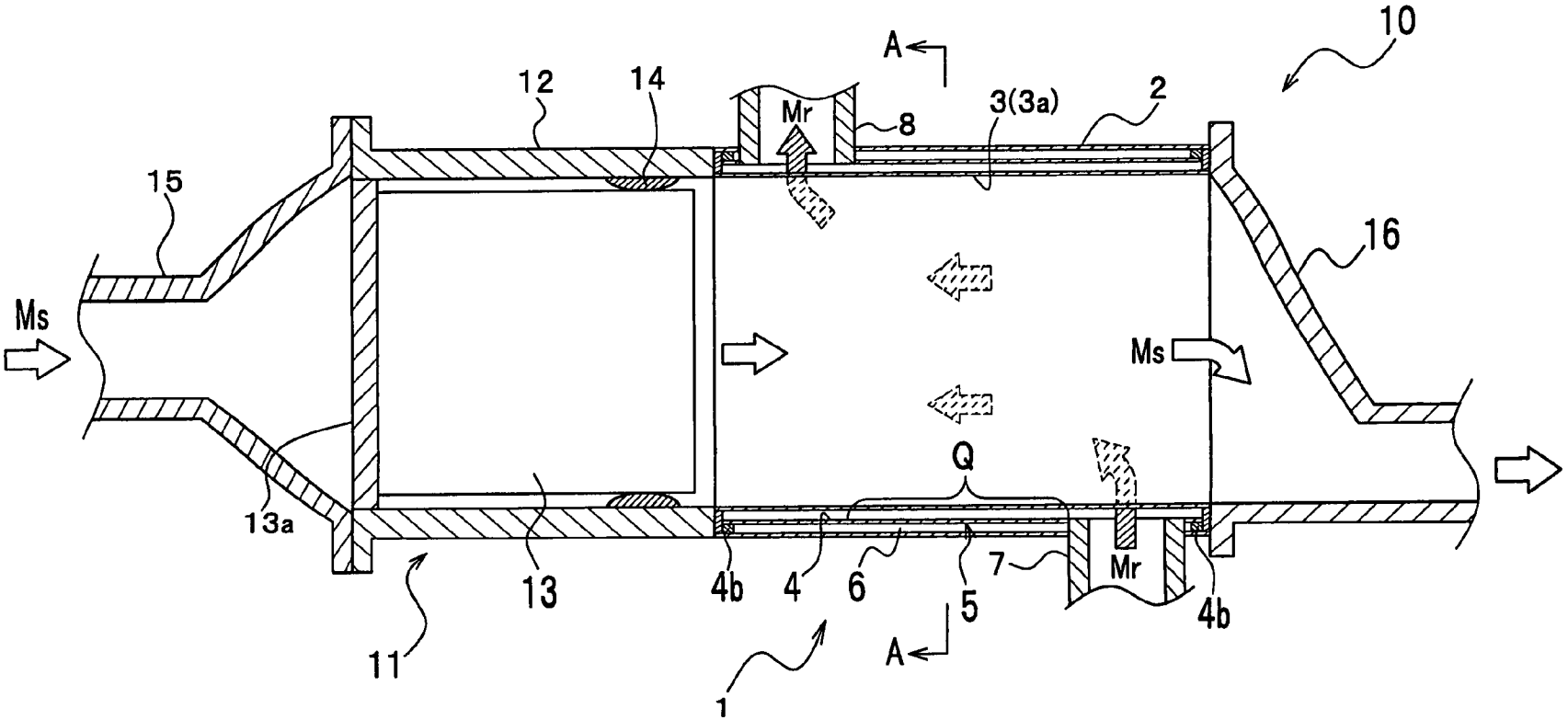
FIG. 1 is a sectional view of a combustion heater having a heat exchanger according to a first embodiment.

Embodiments of the present invention will be described below in detail with reference to the accompanying drawings. In the following description referring to the drawings, the terms "upper", "bottom" and the like are used for the sake of convenience, though the orientation of the device or part may not be the same as in the drawings when they are practically used. Also in the following description, "heat supply pipe" may be frequently used as the same meaning as "heat supply passage". Further in the present invention, the expression "(substantially) uniform" means that difference in temperature near the center of a passage (channel), which is generally high, and at the peripheral side of the passage becomes substantially zero, and temperature of the passage as a whole becomes substantially even.

First Embodiment

Figure 2:
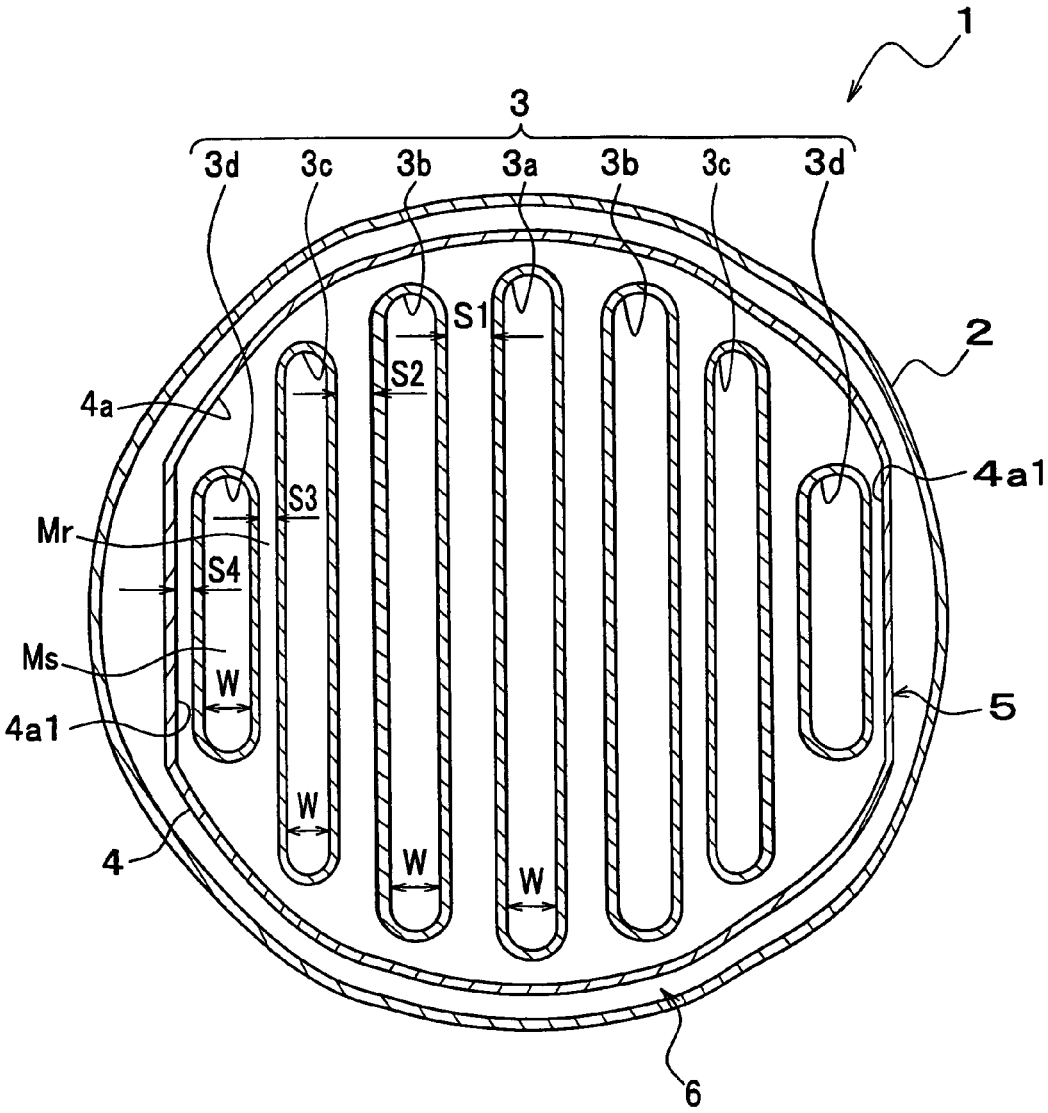
FIG. 2 is a sectional view taken along the line A-A of FIG. 1.

As shown in FIGS. 1 and 2, a heat exchanger 1 of a first embodiment has a heat exchange part 5 which includes a group of heat supply pipes 3 and a heat recovery pipe part 4, all formed of metal material or the like. In the present embodiment, the heat exchange part 5 is configured to be contained in a housing 2 formed of metal material or the like.

As shown in FIG. 2, the group of heat supply pipes 3 is composed of a plurality of (in this embodiment, seven) heat supply pipes 3*a*, 3*b*, 3*b*, 3*c*, 3*c*, 3*d*, 3*d*, each having a passage with a vertically elongated cross section and with a predetermined width of W. When seen as a cross section, the heat supply pipes 3*a*-3*d* are arranged in a transverse (horizontal)

direction with the pipes being parallel to one another with spacing therebetween, while both upper and bottom ends of each heat supply pipe are in proximity to the inner wall 4*a* of the heat recovery pipe part 4. The heat supply pipe 3*a* located at the center of the heat exchange part 5 is the longest in a vertical direction among the heat supply pipes, as shown in FIG. 2. The heat supply pipes 3*b*, 3*b* flanking the sides of the heat supply pipe 3*a* are the second longest; the heat supply pipes 3*c*, 3*c* flanking the external sides (farther sides from the center of the heat exchange part 5) of the heat supply pipes 3*b*, 3*b* are the third longest; and the heat supply pipes 3*d*, 3*d* flanking the external sides of the heat supply pipes 3*c*, 3*c* are the shortest.

In the present embodiment, the group of heat supply pipes 3 explained above as a whole serves as heat supply medium channel. Through the spaces formed in the heat supply pipes 3*a*-3*d*, i.e. heat supply passages, a heat supply medium Ms flows.

It should be noted that configuration, number and arrangement of the heat supply pipes 3 should not be limited to those shown in FIG. 2, and a larger number of the heat supply pipes may be used, or the passage of each heat supply pipe 3 may be divided into two, upper one and bottom one.

The heat recovery pipe part 4 has a nearly cylindrical shape, in which the heat supply pipes 3*a*-3*d* are supported by support members (not shown) with a predetermined spacing between adjacent pipes. With respect to the heat recovery pipe part 4 of the present embodiment, regions of the inner wall 4*a* (inner walls 4*a*1, 4*a*1) facing the external elongated sides of the heat supply pipes 3*d*, 3*d*, are made flat in such manner that the walls are in parallel with the elongated sides of the heat supply pipes 3*d*, 3*d*. As shown in FIG. 1, the heat recovery pipe part 4 is supported at the longitudinal ends thereof in the housing 2 by means of support members 4*b*, 4*b*.

As shown in FIG. 2, in the heat exchange part 5 of the present embodiment, spacings (gaps) between the heat supply pipes 3*a* and 3*b*, between the heat supply pipes 3*b* and 3*c*, between the heat supply pipes 3*c* and 3*d*, and between the heat supply pipe 3*d* and the inner wall 4*a*1 of the heat recovery pipe part 4, are designated as S1, S2, S3 and S4, respectively. The spacings S1-S4 are set in such manner that the spacing located farther in the transverse direction from the center of the heat exchange part 5 becomes smaller (i.e. S1>S2>S3>S4). It should be noted that, though only the left half of the heat exchange part 5 in FIG. 2 is referred for describing the spacings S1-S4, the same explanation is applied to the right half of the heat exchange part 5. In the present embodiment, a space formed between the inner wall of the heat recovery pipe part 4 and the outer walls of the heat supply pipes 3*a*-3*d* serves as heat recovery medium channel, through which a heat recovery medium Mr flows.

The housing 2 is in a form of cylinder, and an air space 6 is provided between the housing 2 and the heat recovery pipe part 4. The presence of the air space 6 enhances insulation effect, and release of heat from the heat exchange part 5 to the external system can be reduced. It should be noted that the space between the housing 2 and the heat recovery pipe part 4 should not be limited to air space, and the space may be filled with a material having insulating property. Alternatively, the heat exchange part 5 may not be contained in the housing 2 and may be used alone.

As shown in FIG. 1, an inlet 7 for supplying the heat recovery medium Mr is provided downstream of the group of heat supply pipes 3 (right side in FIG. 1), at the bottom portion of the heat recovery pipe part 4; and an outlet 8 for discharging the heat recovery medium Mr is provided upstream of the group of heat supply pipes 3 (left side in FIG. 1), at the upper portion of the heat recovery pipe part 4. When seen as a cross section (FIG. 2), parts of the heat recovery medium channel formed in the heat recovery pipe part 4 extend in the longitudinal (vertical) direction along the heat supply pipes 3*a*-3*d*. This structure makes it possible to steadily introduce the heat recovery medium Mr to the space between the heat supply pipes 3*a*-3*d*, when the heat recovery medium Mr is fed from the inlet 7 at the bottom of the heat recovery pipe part 4.

Referring to FIG. 1, in the present embodiment, the heat supply medium Ms is fed from the left end of the housing 2, flows inside the heat supply pipes 3*a*-3*d* (see FIG. 2), and is discharged from the right end of the housing 2; while the heat recovery medium Mr is fed from the inlet 7, flows outside the heat supply pipes 3*a*-3*d* (see FIG. 2), and is discharged from the outlet 8.

As shown in FIG. 1, the heat exchanger 1 according to the present embodiment can be combined with a heat medium producing device 11 and used together as a combustion heater 10 for the fuel cell system F1, which will be described below. The heat medium producing device 11, which is for producing heat supply medium Ms and feeding the heat supply medium Ms to the group of heat supply pipes 3 (heat supply pipes 3*a*-3*d*), includes a cylindrical casing 12 and a catalytic combustion part 13 contained in the casing 12. The catalytic combustion part 13 is formed of a cylindrical substrate having a plurality of fine gas passaages and carrying oxidation catalyst thereon, such as platinum and palladium, and supported by a support member 14 so that the catalytic combustion part 13 faces the introduction ends (left side in FIG. 1) of the heat supply pipes 3*a*-3*d*.

To the upstream, in terms of the heat supply medium Ms, of the heat medium producing device is connected a gas supply pipe 15, which is for introducing a mixed gas of fuel and oxidant as a material for the heat supply medium Ms to the catalytic combustion part 13*a*; and to the downstream of the heat exchanger 1 is connected an exhaust pipe 16 for discharging the heat supply medium Ms.

In the heat exchanger 1 according to the first embodiment, as shown in FIG. 2, the spacings S1-S4 of the heat recovery medium channel each formed between two adjacent components selected from the heat supply pipes 3 and inner wall 4*a*1 are arranged in such manner that the spacings become stepwise narrower in the direction from the center to the periphery of the heat exchange part 5, in other words, cross-sectional areas of the parts of the heat recovery medium channel each formed between two adjacent heat supply pipes 3 (and the inner wall 4*a*1) located farther from the center is made smaller. Therefore, even when the heat supply pipe 3 having smaller cross-sectional area is located farther from the center of the heat exchange part 5, i.e. the amount of heat transferred from the heat supply medium Ms to the heat recovery medium Mr located farther from the center is smaller, the temperature of the heat recovery medium Mr flowing along the heat supply pipes 3*d*, 3*d* located outermost can be prevented from becoming lower than that along the heat supply pipe 3*a* at the center of the heat exchange part 5. Based on this scheme, the arrangement of the cross-sectional area of the heat recovery medium channel can be adjusted so that the temperature distribution of the heat recovery medium Mr passing through the heat recovery medium channel in the heat recovery pipe part 4 becomes substantially uniform.

To put it another way, in the case where the spacings of the parts of the heat recovery medium channel each formed between two adjacent heat supply pipes 3 (and the inner wall 4*a*1) are made equal and the heat supply pipe 3 having smaller cross-sectional area is located farther from the center of the heat exchange part 5, the amount of heat transferred from the heat supply medium Ms to the heat recovery medium Mr located farther from the center is smaller than that to the heat recovery medium located at the center, resulting in unevenness in temperature distribution of the heat recovery medium Mr, with the temperature of the heat recovery medium Mr flowing along the heat supply pipe 3*d*, 3*d* located outermost being lower than that along the heat supply pipe 3*a*. In contrast, as mentioned above, by making the widths of the parts of the heat recovery medium channel each formed between two adjacent heat supply pipes 3 (and the inner wall 4*a*1) stepwise narrower in the direction from the center to the outside (i.e. the width of the part of the heat recovery medium channel along the heat supply passage located farther from the center is made smaller than that located at the center), pressure loss in the part of the heat recovery medium channel located farther from the center becomes larger and flow rate of the heat recovery medium Mr located farther from the center decreases. As a result, at a part located farther from the center, a period for heat exchange between the heat supply medium Ms and the heat recovery medium Mr is elongated, and unevenness in temperature due to lower temperature of the heat recovery medium Mr located farther from the center can be prevented. Though in the above-mentioned embodiment the widths of the parts of the heat recovery medium channel are made stepwise narrower in the direction from the center to the outside, there is no limitation with respect to the configuration of the width arrangement of the heat recovery medium channel, as long as the outer spacing is smaller than the spacing near the center as a whole. For example, some of two adjacent spacings can be the same, and the spacings may have a relationship represented by, for example, S4=S3<S2=S1.

In the heat exchanger 1, the heat supply medium Ms and the heat recovery medium Mr flow parallelly in opposite directions to each other. Therefore, uniform temperature distribution is facilitated as compared with the case where the heat supply medium Ms and the heat recovery medium Mr flow in the directions perpendicular to each other.

Since the temperature distribution of the heat recovery medium Mr can be made substantially uniform as mentioned above, heat exchange efficiency can be improved. By improving the heat exchange efficiency and thus effectively recovering heat from the heat supply medium Ms, local elevation of temperature of the heat recovery medium Mr can be prevented. As a result, denaturation or deterioration of the heat recovery medium Mr can be avoided.

Figure 3:
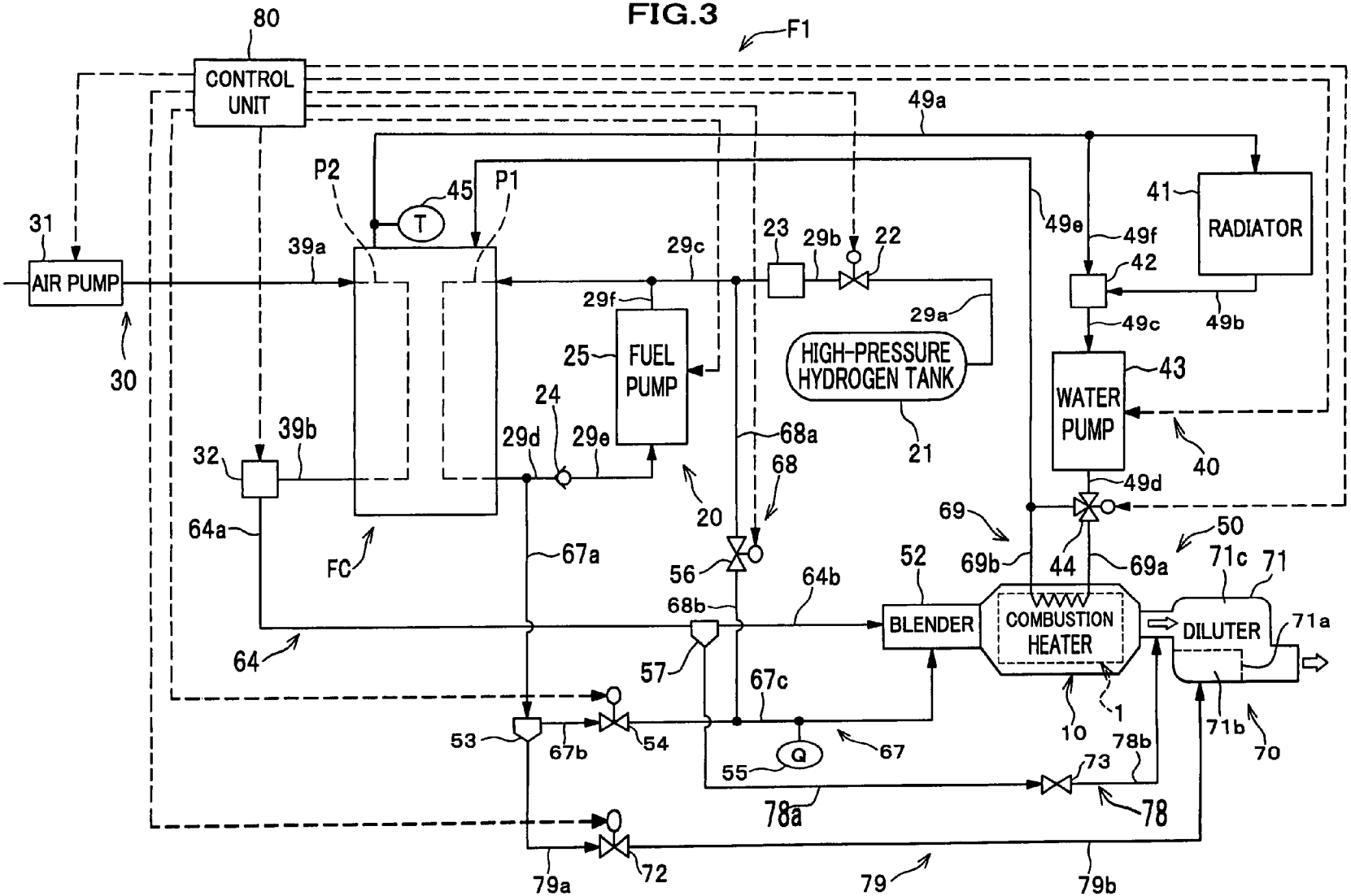
FIG. 3 is a block diagram of the heat exchanger according to one embodiment of the present invention in the case where the heat exchanger is installed in a fuel cell system for vehicle.

The operation of the heat exchanger 1 of the present embodiment will be described, with reference to the heat exchanger incorporated in a fuel cell system F1 for vehicle (see FIG. 3). In this embodiment, the heat exchanger 1 is installed in a combustion heater 10 of the fuel cell system F1. The combustion heater 10 is used for heating a coolant (heat recovery medium Mr) flowing through a cooling system 40 of the fuel cell FC for the purpose of warming up the fuel cell FC.

First, referring to FIG. 3, the whole structure of the fuel cell system F1 is explained below.

The fuel cell system F1 includes a fuel cell FC, a hydrogen-supply system 20, an air-supply system 30, a cooling system 40, a warm-up system 50, a diluting system 70 and a control unit 80.

The fuel cell FC is a PEM (Proton Exchange Membrane) type fuel cell having an anode (hydrogen electrode) P1 and a cathode (oxygen electrode) P2. Electricity is generated with hydrogen as a fuel gas and air as an oxidant gas, supplied to the anode P1 and the cathode P2, respectively.

In the hydrogen-supply system 20, a high-pressure hydrogen tank 21, a cutoff valve 22 and a regulator (pressure reducing means) 23 are disposed upstream of the anode P1, while a check valve 24 and a fuel pump 25 are disposed downstream of the anode P1. The components of the hydrogen-supply system 20 are connected to one another through the fuel pipings 29*a*-29*f*. Hydrogen is supplied from the high-pressure hydrogen tank 21 to the anode P1 through the cutoff valve 22 and the regulator 23. The anode exhaust gas purged from the anode P1 is introduced to the fuel pump 25 through the check valve 24, and reintroduced (recirculated) to the anode P1 by the fuel pump 25.

In the air-supply system 30, an air pump 31 is disposed upstream of the cathode P2, and a back-pressure regulating valve 32 is disposed downstream of the cathode P2. The air pump 31 is, for example, a supercharger driven by a motor, and the rotational speed of the motor is controlled by a signal from the control unit 80. The components of the air-supply system 30 are connected to one another through the air pipings 39*a*, 39*b*. The back-pressure regulating valve 32 is activated by a signal from the control unit 80. Air supplied to the fuel cell FC is humidified by a humidifier (not shown).

The cooling system 40 includes a radiator 41, a thermostat valve 42, a water pump 43 and a three-way electromagnetic valve 44. The components of the cooling system 40 are connected to one another through the coolant pipings 49*a*-49*f*, and on the coolant piping 49*a* a temperature sensor 45 is disposed which monitors the temperature of the coolant at the exit side of the fuel cell FC as a temperature of the fuel cell FC. The thermostat valve 42 controls the flow of the coolant so that the coolant circulates without passing through the radiator 41 during cooling down after start-up, in order to facilitate the warming up of fuel cell FC. The three-way electromagnetic valve 44 is activated by a signal from the control unit 80, and is switched between two modes: a regular operation mode in which the coolant from the water pump 43 is directly fed to the fuel cell FC without passing through the combustion heater 10, and a warm-up operation mode in which the coolant is fed to the combustion heater 10.

The warm-up system 50 includes a combustion heater 10 in which the heat exchanger 1 of the present embodiment is installed. In the combustion heater 10, anode exhaust gas and hydrogen (fuel gas) are burnt, and the obtained thermal energy is used for warm-up of the fuel cell. The warm-up system 50 further includes a blender 52 which mixes the anode exhaust gas or hydrogen with the cathode exhaust gas prior to the introduction to the combustion heater 10.

The warm-up system 50 also includes a first fuel gas line 67 which leads the anode exhaust gas to the blender 52; a third fuel gas line 68 which leads hydrogen to the blender 52; a first cathode exhaust gas line 64 which leads the cathode exhaust gas to the blender 52; and a warm-up coolant line 69 which leads the coolant of the fuel cell FC to the combustion heater 10.

The first fuel gas line 67 includes fuel pipings 67*a*-67*c* communicating between the fuel piping 29*d* downstream of the anode P1 and the blender 52; a steam separator 53 connected to the fuel pipings 67*a* and 67*b*; and a first gas flow control valve 54 disposed between the fuel pipings 67*b* and 67*c*. The first gas flow control valve 54 is activated by a signal from the control unit 80. The steam separator 53 separates moisture from the anode exhaust gas from the fuel piping 67*a* by use of plates (not shown), the anode exhaust gas from which moisture has been removed is sent to the fuel piping 67*b* on the blender 52 side, and the anode exhaust gas containing moisture is sent to the fuel piping 79*a* (which will be described below) on the diluter 71 side. The fuel piping 67*c* is equipped with a flow sensor 55 for measuring the amount of fuel gas supply to the blender 52.

The third fuel gas line 68 includes fuel pipings 68*a* and 68*b* communicating between the fuel piping 29*c* of the hydrogen-supply system 20 and the fuel piping 67*c* of the first fuel gas line 67; a third gas flow control valve 56 disposed between the fuel pipings 68*a* and 68*b*. The third gas flow control valve 56 is controlled by a signal from the control unit 80.

The first cathode exhaust gas line 64 includes air pipings 64*a* and 64*b* communicating between the exhaust side of the back-pressure regulating valve 32 of the air-supply system 30 and the blender 52; and a steam separator 57 disposed between the air pipings 64*a* and 64*b*. The steam separator 57 is plate type as explained with respect to the steam separator 53, which separates moisture from the cathode exhaust gas in the air piping 64*a* on the cathode P2 side by use of a plate. The cathode exhaust gas from which moisture has been removed is sent to the air piping 64*b* on the blender 52 side, and the cathode exhaust gas containing moisture is sent to the air piping 78*a* on the diluter 71 side.

The warm-up coolant line 69 includes a coolant piping 69*a* for supplying the coolant from the three-way electromagnetic valve 44 to the combustion heater 10; and a coolant piping 69*b* for supplying the coolant which has been heated by the combustion heater 10 to the fuel cell FC.

The diluting system 70 includes a diluter 71 connected to the combustion heater 10, in which diluter 71 the anode exhaust gas and exhaust gas from the combustion heater 10 are diluted with oxygen-containing gas and the diluted gas is released to the atmosphere. The diluter 71 is partitioned with a perforated plate 71*a* into a retention chamber 71*b* and a diffusion chamber 71*c*. The anode exhaust gas introduced to the retention chamber 71*b* gradually flows into the diffusion chamber 71*c* through the perforated plate 71*a*. After being diluted with oxygen-containing gas in the diffusion chamber 71*c*, the diluted gas is released to the atmosphere.

The diluting system 70 further includes a second fuel gas line 79 for leading the anode exhaust gas to the diluter 71, and a second cathode exhaust gas line 78 for leading the cathode exhaust gas to the diluter 71.

The second fuel gas line 79 includes fuel pipings 79*a* and 79*b* communicating between the steam separator 53 and the retention chamber 71*b* of the diluter 71; and a second gas flow control valve 72 disposed between the fuel pipings 79*a* and 79*b*. The second gas flow control valve 72 is activated by a signal from the control unit 80.

The second cathode exhaust gas line 78 includes air pipings 78*a* and 78*b* communicating between the steam separator 57 and the diluter 71; and an orifice 73 disposed between the air piping 78*a* and the air piping 78*b*.

Next, warm-up control of a vehicle with the fuel cell system F1 mounted thereon will be explained below.

When a driver turns on an ignition switch (not shown) of the vehicle, the control unit 80 begins a warm-up control. The control unit 80 switches the three-way electromagnetic valve 44 to the warm-up operation mode in which the coolant from the water pump 43 is sent to the combustion heater 10. Then, the control unit 80 opens the third gas flow control valve 56 by a predetermined amount, and closes the first gas flow control valve 54 and the second gas flow control valve 72, to thereby lead hydrogen from the high-pressure hydrogen tank 21 through the third fuel gas line 68 and the fuel piping 67*c* to the blender 52. The introduction amount of hydrogen is monitored by the flow sensor 55. On the other hand, nearly the whole amount of the cathode exhaust gas discharged from the cathode P2 is introduced to the blender 52 through the first cathode exhaust gas line 64.

Hydrogen and cathode exhaust gas (oxygen) are mixed together in the blender 52, and the mixture is introduced to the combustion heater 10. As shown in FIG. 1, in the catalytic combustion part 13 of the combustion heater 10, hydrogen and oxygen in the cathode exhaust gas are subjected to catalytic combustion, and a heat supply medium (combustion gas) Ms having thermal energy is produced, and sent to the heat exchanger 1. In the heat exchanger 1, the heat supply medium Ms flows through the heat supply pipes 3*a*-3*d* as the heat supply medium channel, in the direction towards the exhaust pipe 16. At the same time, the heat recovery medium (coolant) Mr flows through the coolant piping 69*a*; then is fed from the inlet 7 to the heat recovery medium channel between the heat recovery pipe part 4 and the heat supply pipes 3*a*-3*d*, so as to flow in parallel with but in opposite direction to the flow of the heat supply medium Ms; and is discharged from the outlet 8. In the combustion heater 10, heat of the heat supply medium Ms is transferred to the heat recovery medium Mr through the heat supply pipes 3*a*-3*d*. The heat recovery medium Mr that has been heated is supplied to the fuel cell FC through the coolant piping 69*b* and the coolant piping 49*e*. While supplying the heat recovery medium Mr, the temperature of the fuel cell FC is monitored by the temperature sensor 45, and warm-up is continued by supplying hydrogen and the cathode exhaust gas (oxygen) to the combustion heater 10 until the temperature of the fuel cell FC reaches the temperature at which electricity generation is possible. After completion of warm-up, the three-way electromagnetic valve 44 is switched to the regular operating mode in which the heat recovery medium Mr (coolant) from the water pump 43 is fed directly to the fuel cell FC, not through the combustion heater 10.

It should be noted that the above-mentioned warm-up control is merely one example, and appropriate modifications can be made depending on the temperature of the fuel cell FC during warm-up. For example, hydrogen may not be supplied directly from the high-pressure hydrogen tank 21 to the blender 52, but instead, the fuel cell system F1 may be warmed up with the anode exhaust gas discharged from the fuel cell FC as fuel, by utilizing discharging treatment (purge treatment) of water or impurities remaining in the anode P1 or the fuel pipings 29*c*-29*f* upon start-up of the fuel cell system F1 (when the ignition switch is turned on).

In this manner, in the case where warm-up is conducted by utilizing the anode exhaust gas of purge treatment, the three-way electromagnetic valve 44 is switched to the warm-up operation mode by the control unit 80. At the same time, the third gas flow control valve 56 is closed, the first gas flow control valve 54 is opened, and the second gas flow control valve 72 is closed to thereby supply to the blender 52 substantially the whole amount of the anode exhaust gas discharged from the anode P1 and substantially the whole amount of the cathode exhaust gas discharged from the cathode P2. As a result, catalytic combustion of the anode exhaust gas and the cathode exhaust gas takes place in the combustion heater 10, which produces a heat supply medium Ms (i.e. thermal energy). As explained above, the anode exhaust gas can be utilized in warm-up of the fuel cell FC, while in the conventional heat exchanger the anode exhaust gas has been exhausted from the system. Therefore, fuel consumption can be lowered as compared with the conventional heat exchanger. Further more, moisture contained in the anode exhaust gas and the cathode exhaust gas is removed in the steam separator 53 and the steam separator 57, respectively. Supplying the anode exhaust gas and the cathode exhaust gas containing no moisture to the combustion heater 10 facilitates stable combustion.

Since heat exchange efficiency is enhanced by installing the heat exchanger 1 of the present embodiment into the combustion heater 10, the amount of the fuel (hydrogen) during warm-up of the fuel cell system F1 for vehicle can be reduced, and at the same time, it becomes possible to reduce size and weight of the device.

Second Embodiment

Figure 4:
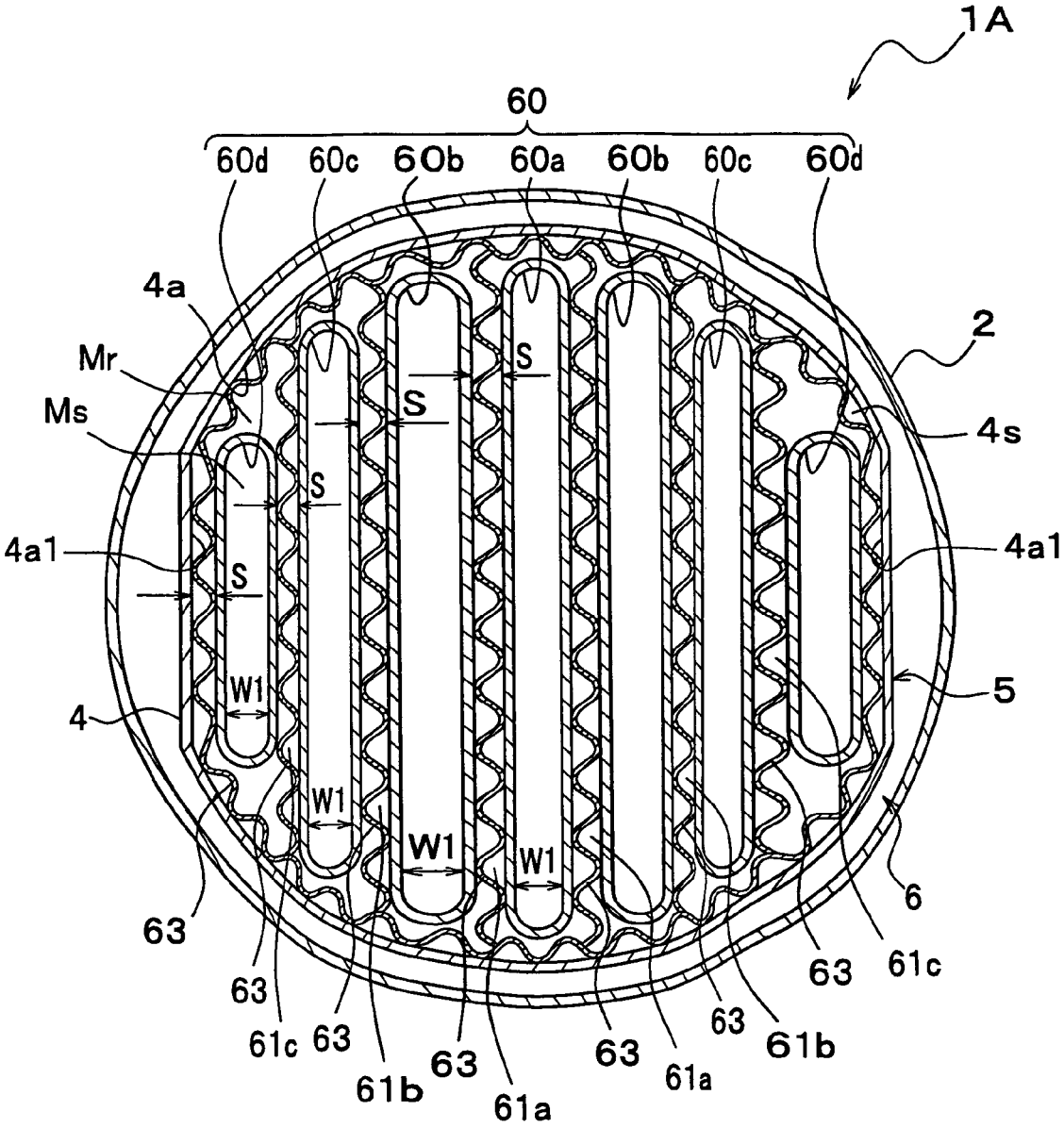
FIG. 4 is a sectional view of a heat exchanger according to a second embodiment taken along the line corresponding to the line A-A of FIG. 1.

FIG. 4 is a sectional view of a heat exchanger according to a second embodiment taken along the line corresponding to the line A-A of FIG. 1.

The heat exchanger 1A has a group of heat supply pipes 60 composed of a plurality of (in the present embodiment, seven) heat supply pipes 60*a*, 60*b*, 60*b*, 60*c*, 60*c*, 60*d*, 60*d*. The essential configuration of the group of heat supply pipes 60 is the same as that of the group of heat supply pipes 3, and the widths of the passages of the heat supply pipes 60*a*-60*d* are made equal to one another (width W1). However, the spacings between the heat supply pipes 60*a* and 60*b*, between the heat supply pipes 60*b* and 60*c*, between the heat supply pipes 60*c* and 60*d*, and between the heat supply pipe 60*d* and the inner wall 4*a*1 of the heat recovery pipe part 4 are also made equal (spacing S).

In the heat recovery pipe part 4 of the heat exchanger 1A, elongated inner passages 61*a*, 61*a*, 61*b*, 61*b*, 61*c*, 61*c*, which are parts of the heat recovery medium channel formed between the heat supply pipes 60*a*-60*d*, as well as a peripheral passage 4*s* formed along the inner periphery of the heat recovery pipe part 4 are provided with fins 63. The fin 63 is, for example, formed of a metal plate having a waved cross section (corrugation). In this embodiment, the fins 63 are placed in the space of the heat recovery medium channel indicated by a range Q in FIG. 1, which range Q is defined between a plane orthogonally crossing the heat recovery pipe part 4 at the most downstream point (in terms of the heat recovery medium Mr) on the junction of the heat recovery pipe part 4 with the inlet 7 and a plane orthogonally crossing the heat recovery pipe part 4 at the most upstream point on the junction of the heat recovery pipe part 4 with the outlet 8, so as not to block the flow of the heat recovery medium Mr. The range Q for placing the fins 63 is not limited to one shown in FIG. 1, and may either be larger or smaller than that shown in FIG. 1.

As described above, in the heat exchanger 1A of the second embodiment, the heat supply medium Ms is fed in the heat supply pipes 60*a*-60*d* composing the group of heat supply pipes 60, so as to flow in parallel with but in opposite direction to the flow of the heat recovery medium Mr passing through the space between the heat supply pipes 60*a*-60*d* and the heat recovery pipe part 4. In this case, the fins 63 reduces the cross-sectional area of the heat recovery pipe part 4, resulting in increase in pressure loss, i.e. lowering of flow velocity (flow rate) of the heat recovery medium Mr. For this reason, the amount of heat transferred from the heat supply medium Ms to the heat recovery medium Mr can be increased, to thereby prevent temperature unevenness of heat recovery medium and thus enhance heat exchange efficiency.

Third Embodiment

Figure 5:
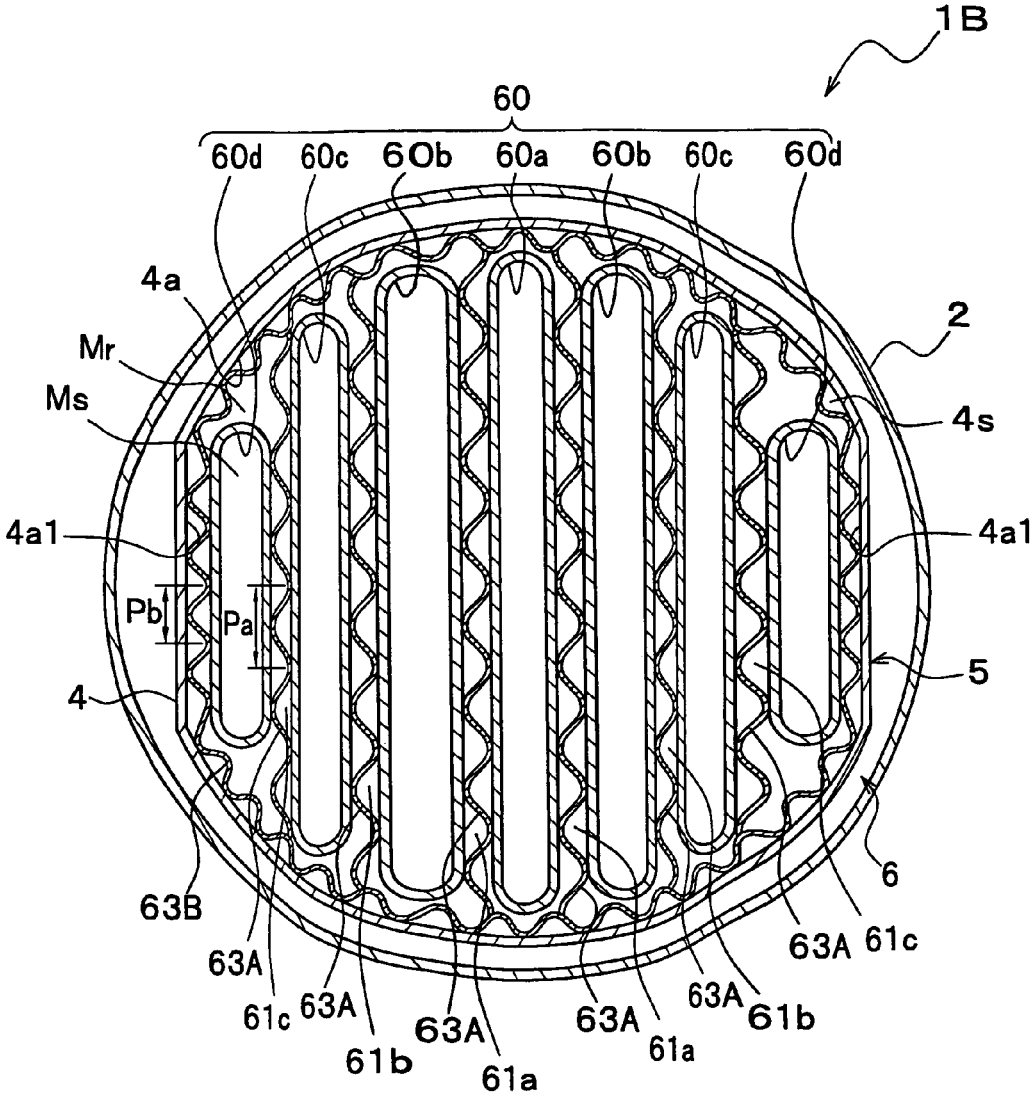
FIG. 5 is a sectional view of a heat exchanger according to a third embodiment taken along the line corresponding to the line A-A of FIG. 1.

FIG. 5 is a sectional view of a heat exchanger according to a third embodiment taken along the line corresponding to the line A-A of FIG. 1. The heat exchanger 1B of the third embodiment is different from the heat exchanger 1A of the second embodiment in that the corrugation pitch of the corrugated fins placed in the inner passages 61*a*-61*c* (fins 63A) is different from that of the fin placed in the peripheral passage 4*s* (fin 63B).

In other words, the corrugation pitch Pa of the fin 63A provided in the inner passages 61*a*-61*c* (i.e. the inner passage 61*a* between the heat supply pipes 60*a* and 60*b*; the inner passage 61*b* between the heat supply pipes 60*b* and 60*c*; and the inner passage 61*c* between the heat supply pipes 60*c* and 60*d*) is set larger than the corrugation pitch Pb of the fin 63B provided in the peripheral passage 4*s* on the inner periphery of the heat recovery pipe part 4.

Since the heat supply medium Ms is not present outside the heat exchange part 5, the temperature of the heat recovery medium Mr in the area along the inner periphery of the heat recovery medium channel would become lower than that of the heat recovery medium Mr present in the other areas, resulting in uneven distribution of temperature. However, as described above, the fin 63B having a shorter corrugation pitch Pb is provided to the peripheral passage 4*s* along the inner periphery of the heat recovery medium channel in the heat recovery pipe part 4. Since the cross-sectional area of the heat recovery medium channel along the inner periphery becomes smaller, pressure loss becomes larger, and therefore flow velocity (flow rate) of the heat recovery medium Mr is lowered, leading to increase in heat transferred to the heat recovery medium Mr. The prevention of lowering in the temperature of the heat recovery medium Mr in the peripheral passage 4*s* leads to substantially uniform temperature distribution of the whole heat recovery medium Mr, which in turn enhances heat exchange efficiency.

Fourth Embodiment

Figure 6A:
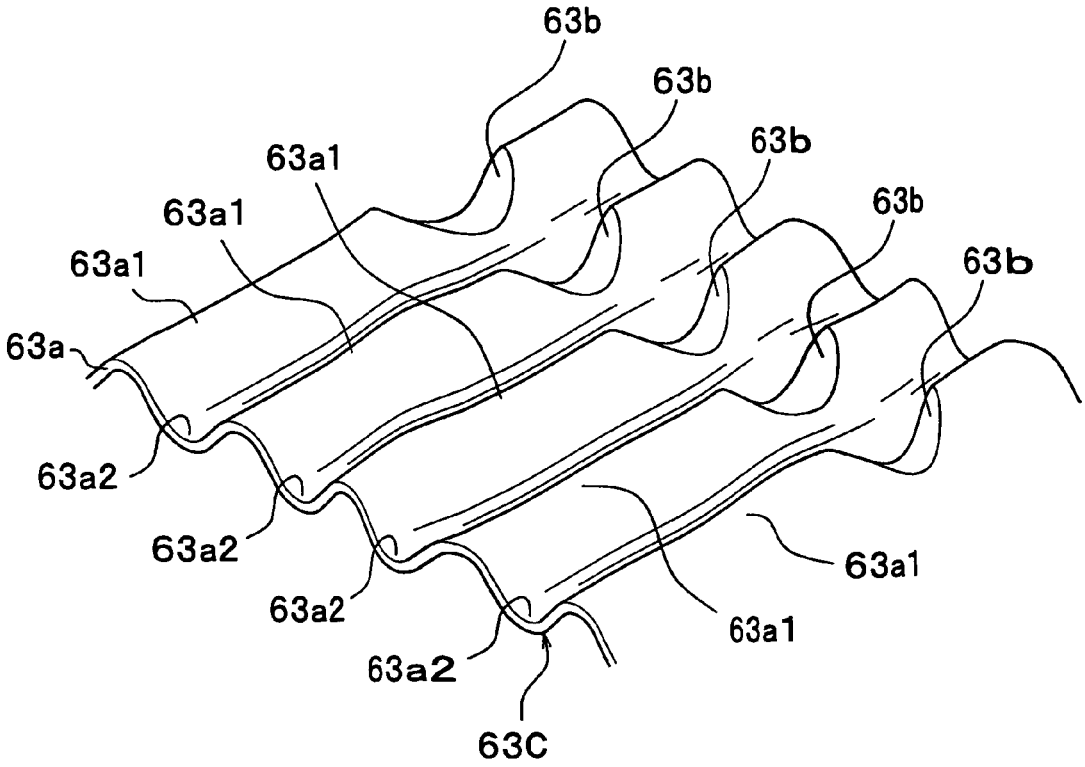
FIG. 6A is a perspective view of a part of a single fin of a heat exchanger according to a fourth embodiment.
Figure 6B:
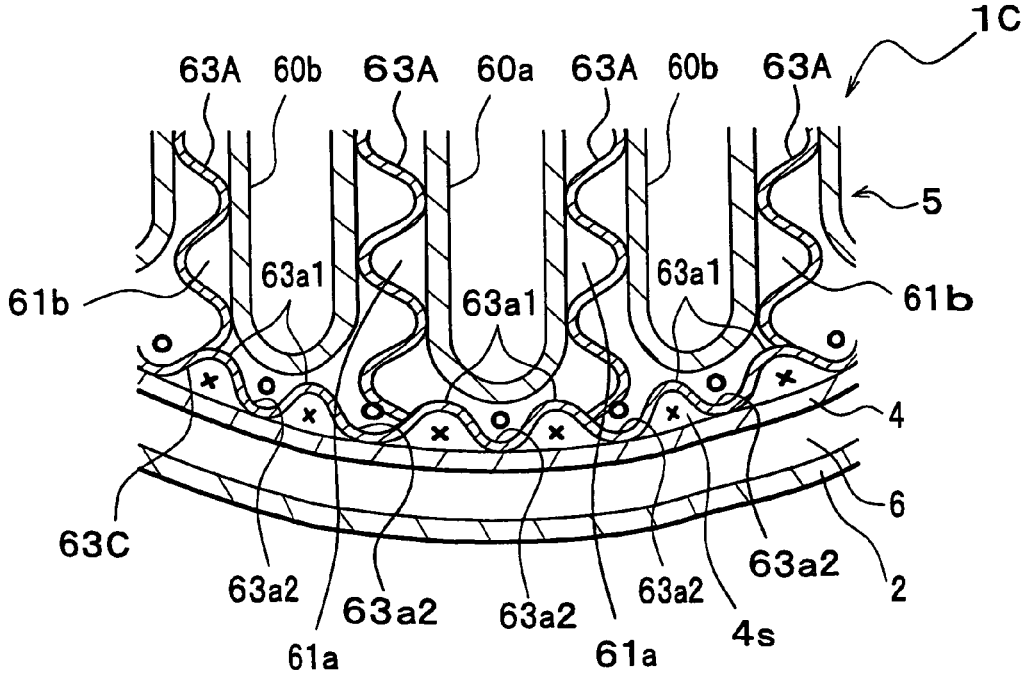
FIG. 6B is a partially enlarged sectional view of the heat exchanger according to the fourth embodiment.

FIG. 6A is a perspective view of a part of a single fin of a heat exchanger according to a fourth embodiment. FIG. 6B is a partially enlarged sectional view of the heat exchanger according to the fourth embodiment. The heat exchanger 1C of the fourth embodiment has a fin 63C which is a modified version of the fin 63 of the heat exchanger 1A of the second embodiment.

As shown in FIG. 6A, the fin 63C of the heat exchanger 1C is formed of a corrugated (waved) plate 63*a*, with a part of each crest line 63*a*1 being squashed on one side (upper side in FIG. 6A), so that a line of closure parts 63*b*, 63*b*, each in a form of dent, crosses the crest lines 63*a*1. Such a fin 63C is disposed along the peripheral passage 4*s* on the inner periphery of the heat recovery pipe part 4 (see FIG. 6B) in such manner that the dent side of the closure part 63*b* faces towards the center (i.e. the heat supply pipes 60*a*-60*d*).

According to the heat exchanger 1C of the fourth embodiment, when the heat recovery medium Mr is introduced to the heat recovery pipe part 4, the heat recovery medium Mr can flow along the valley lines 63*a*2 of the corrugate plate 63*a* on one side of the fin 63C, as indicated with "O" in FIG. 6B. On the other hand, the flow of the heat recovery medium Mr is blocked at each closure part 63*b* on the other side of the fin 63C, as indicated with "X" in FIG. 6B. Therefore, in the present embodiment, cross sectional area of the peripheral passage 4*s* in the heat recovery pipe part 4 is reduced, resulting in increase in pressure loss, i.e. lowering of flow velocity (flow rate) of the heat recovery medium Mr. By reducing the amount of heat released from the heat recovery medium Mr flowing through the peripheral passage 4*s* to the external system, the lowering of the temperature of the heat recovery medium Mr passing through the peripheral passage 4*s* is prevented as compared with the heat recovery medium Mr passing through other passages (inner passages 61*a*-61*c* in the third embodiment), leading to substantially uniform temperature distribution of the whole heat recovery medium Mr.

Figure 7:
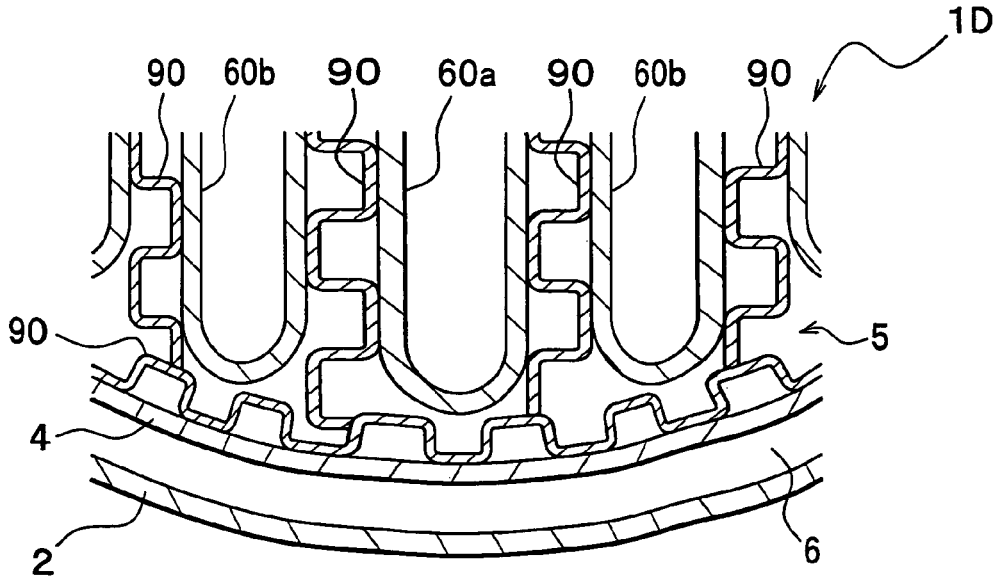
FIG. 7 is a partially enlarged sectional view of a heat exchanger having fins with modified shape.
Figure 8:
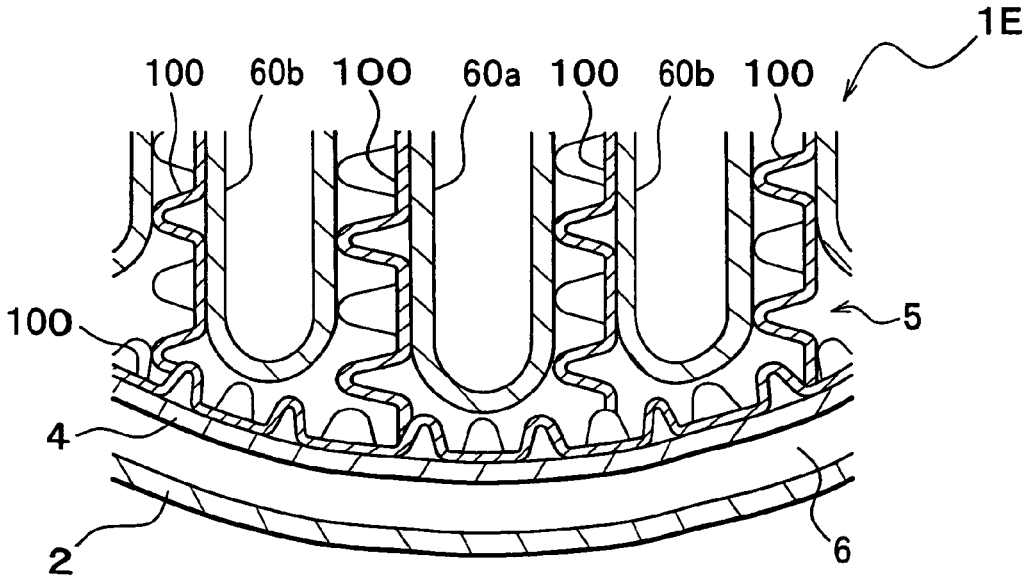
FIG. 8 is a partially enlarged sectional view of a heat exchanger having fins with another modified shape.

It should be noted that there is no limitation with respect to the uneven pattern of the fins, though in the second, third and fourth embodiments the fins 63, 63A, 63B and 63C are in the form of corrugation. For example, as in the heat exchanger 1D of FIG. 7, fins 90 may be in the shape of squared corrugation. Alternatively, as in the heat exchanger 1E of FIG. 8, fins 100 may have discontinuous crest lines, with discontinuous portions on adjacent crest lines being arranged alternately. Further in the heat exchangers 1D and 1E, the pitches of the fins 90 and 100 located in the peripheral passage 4*s* may be made smaller than those located at the inner passages 61*a*-61*c*, as shown in the third embodiment. In the heat exchanger 1E, the passages formed between the inner periphery of the heat recovery pipe part 4 and the fin 100 located in the peripheral passage 4*s* may be blocked, in the same manner as in the fourth embodiment.

Although the embodiments of the present invention are described, the invention is not limited thereto and can be embodied with being changed as needed. For example, following modification can be made. With respect to the heat exchanger 1 of the first embodiment shown in FIG. 2, the widths of the parts of the heat recovery medium channels between the heat supply pipes 3*a*-3*d* and the inner wall 4*a*1 are formed so that the width becomes smaller for the part located farther from the center of the heat exchange part 5. Instead, the passage widths of the heat supply pipes 3*a*-3*d* may be formed so that the width becomes larger for the pipe located farther from the center of the heat exchange part 5, while the widths of the parts of the heat recovery medium channels between the heat supply pipes 3*a*-3*d* are made equal.

In each of the embodiments above, the heat supply medium Ms and the heat recovery medium Mr flow parallelly in opposite directions to each other. However, there is no limitation with respect to the directions of the flow, and the heat supply medium Ms and the heat recovery medium Mr may flow parallelly in the same direction.

In addition, the first and second embodiments can be combined. In other words, widths of parts of the heat recovery medium channel each formed between two adjacent components, selected from the heat supply passages and an inner wall of the heat recovery medium channel, may be arranged so that the width located farther from the center of the heat exchange part is smaller, and at the same time, fins having a waved cross section may be introduced. In this heat exchange part, a pitch of wave pattern of the fin provided in a peripheral part of the heat recovery medium channel may be made smaller as compared with a pitch of wave pattern of the fins provided in parts of the heat recovery medium channel each formed between two adjacent heat supply passages, and the fin placed along the inner periphery of the heat recovery medium channel may be configured to block passages formed between the fin and the inner periphery of the heat recovery medium channel.

What is claimed is:

1. A fuel cell system comprising a heat exchanger having a heat exchange part, wherein the heat exchanger comprises:

a heat supply medium channel comprising a plurality of heat supply passages;

a heat recovery medium channel surrounding the heat supply medium channel; and one or more fins in a peripheral part of the heat recovery medium channel and in parts of the heat recovery medium channel between two adjacent heat supply passages, wherein the heat exchange part is arranged such that, during operation, a heat supply medium passing through the heat supply medium channel exchanges heat with a heat recovery medium passing through the heat recovery medium channel, wherein the one or more fins form a wave pattern, and a pitch of the wave pattern of the one or more fins in the peripheral part of the heat recovery medium channel is smaller than a pitch of the wave pattern of the one or more fins in the parts of the heat recovery medium channel between two adjacent heat supply passages, wherein cross-sectional space available to accommodate heat recovery medium flow in different sections of the heat recovery medium channel is proportional to an amount of heat to be transferred from the heat supply medium to the heat recovery medium in each of the different sections, wherein each heat supply passage has a vertically elongated cross section and a predetermined width, and the heat supply passages are arranged parallel to one another in a transverse direction with spacing therebetween.

2. The fuel cell system according to claim 1 wherein the cross-sectional space available to accommodate heat recovery medium flow in the different sections of the heat recovery medium channel is dependent on the wave pattern of the one or more fins.

3. The fuel cell system according to claim 1, wherein a fin of the one or more fins is placed along an inner periphery of the heat recovery medium channel and is configured to block passages formed between the fin and the inner periphery of the heat recovery medium channel.

4. The fuel cell system according to claim 1, wherein the heat supply medium and the heat recovery medium flow parallel to one another and in opposite directions in the heat exchange part.

5. An apparatus comprising a vehicle, wherein the vehicle includes:

a fuel cell system including a heat exchanger having a heat exchange part, wherein the heat exchanger comprises:

a heat supply medium channel comprising a plurality of heat supply passages;

a heat recovery medium channel surrounding the heat supply medium channel; and one or more fins in a peripheral part of the heat recovery medium channel and in parts of the heat recovery medium channel between two adjacent heat supply passages, wherein the heat exchange part is arranged such that, during operation, a heat supply medium passing through the heat supply medium channel exchanges heat with a heat recovery medium passing through the heat recovery medium channel, wherein the one or more fins form a wave pattern, and a pitch of the wave pattern of the one or more fins in the peripheral part of the heat recovery medium channel is smaller than a pitch of the wave pattern of the one or more fins in the parts of the heat recovery medium channel between two adjacent heat supply passages, wherein cross-sectional space available to accommodate heat recovery medium flow in different sections of the heat recovery medium channel is proportional to an amount of heat to be transferred from the heat supply medium to the heat recovery medium in each of the different sections, wherein each heat supply passage has a vertically elongated cross section and a predetermined width, and the heat supply passages are arranged parallel to one another in a transverse direction with spacing therebetween.

* * * * *